US005115276A

United States Patent [19]

Miskinis et al.

[11] Patent Number: 5,115,276

[45] Date of Patent: May 19, 1992

[54] MAGNETIC BRUSH DEVELOPMENT APPARATUS

[75] Inventors: Edward T. Miskinis, Rochester; Frank H. Johnson, Victor; Francis M. Paczkowski, Rochester, all of N.Y.

[73] Assignee: Eastman Kodak Company, Rochester, N.Y.

[21] Appl. No.: 755,402

[22] Filed: Sep. 5, 1991

[51] Int. Cl.[5] ..... G03G 15/09

[52] U.S. Cl. ..... 355/253; 355/251; 355/259; 118/657

[58] Field of Search ..... 355/245, 251, 253, 259; 118/657, 658, 653

[56] References Cited

U.S. PATENT DOCUMENTS

| | | | |
|---|---|---|---|
| 3,777,707 | 12/1973 | Hodges | 118/637 |
| 3,865,080 | 2/1975 | Hudson | 118/657 X |
| 3,950,089 | 4/1977 | Fraser et al. | 355/253 |
| 4,034,709 | 7/1977 | Fraser et al. | 118/658 |
| 4,080,054 | 3/1978 | Watanabe | 355/253 |
| 4,383,497 | 5/1983 | Tajima | 118/653 X |
| 4,459,009 | 7/1984 | Hays et al. | 355/259 |
| 4,505,573 | 3/1985 | Brewington et al. | 355/259 |
| 4,548,489 | 10/1985 | Yoshikawa | 355/253 |
| 4,559,899 | 12/1985 | Kan et al. | 118/657 |
| 4,571,059 | 2/1986 | Huss | 355/274 |
| 4,572,631 | 2/1986 | Kondo | 355/253 |
| 4,669,852 | 6/1987 | Tajima et al. | 355/253 |
| 4,671,207 | 6/1987 | Hilbert | 118/657 |
| 4,690,096 | 9/1987 | Hacknauer et al. | 118/657 |
| 4,774,541 | 9/1988 | Martin et al. | 355/259 |
| 4,876,574 | 10/1989 | Tajima et al. | 355/253 |

*Primary Examiner*—A. T. Grimley
*Assistant Examiner*—Nestor R. Ramirez
*Attorney, Agent, or Firm*—Lawrence P. Kessler

[57] ABSTRACT

A magnetic brush development apparatus for applying pigmented marking particles to a latent image charge pattern on a dielectric member. The magnetic brush development apparatus comprises a housing defining, in a portion thereof, a sump for containing a mixture of magnetic carrier particles and pigmented marking particles. A mixer is located in the sump of the housing for mixing magnetic carrier particles and pigmented marking particles so as to effect a triboelectric attraction of the pigmented marking particles to the magnetic carrier particles. The mixed magnetic carrier particles and attracted pigmented marking particles are attracted to an intermediate member, transported by the intermediate member from the sump, and then separated by the intermediate member such that the magnetic carrier particles are returned to the sump. A magnetic brush development roller including a magnetic core and a shell rotatable relative to one another, has the shell coated with a prescribed layer of magnetic carrier particles and an electrical bias applied to the shell. The marking particles are attracted from the intermediate member to the magnetic brush and then transferred to a latent image charge pattern on the dielectric member to develop such pattern.

11 Claims, 2 Drawing Sheets

MAGNETIC BRUSH DEVELOPMENT APPARATUS

BACKGROUND OF THE INVENTION

This invention relates in general to magnetic brush development apparatus, and more particularly to a magnetic brush development apparatus of reduced size and which maintains substantially optimum pigmented marking particle (toner) concentration without the use of a toner monitor.

In electrostatographic reproduction apparatus, it is a well known practice to develop a latent image charge pattern on a dielectric member with pigmented marking particles by applying such particles to the image with a magnetic brush development apparatus. The typical magnetic brush development apparatus includes a sump containing a mixture of magnetic (ferrite) carrier particles and relatively smaller pigmented marking particles (commonly referred to as toner). The magnetic carrier particles and pigmented marking particles are agitated in the sump to effect a triboelectric attraction of the pigmented marking particles to the magnetic carrier particles. The magnetic carrier particles with the attracted pigmented marking particles are fed to a development roller which includes an alternating pole magnet within a nonmagnetic shell. The magnet and shell of the development roller rotate relative to one another causing the magnetic carrier particles (and attracted pigmented marking particles) to form a multibristle-like arrangement on the shell in the field of the magnet. The bristles, moving as the magnet and shell relatively rotate, are swept over the dielectric member in a development zone where the pigmented marking particles are attracted from the magnetic carrier particles to the latent image charge pattern to develop the pattern.

During operation of the magnetic brush development apparatus, the combined magnetic carrier particle/pigmented marking particle material is constantly fed to the development roller upstream of the development zone and removed from the roller downstream of the development zone (by a mechanical skive for example). A relatively large amount of magnetic carrier particles are required in the described circulation of material between the development apparatus sump and the magnetic brush roller to adequately effect latent image charge pattern development. This results in a development apparatus of substantial size. Moreover, since the pigmented marking particles are constantly being removed from the combined material in order to effect development, the concentration of pigmented marking particles (toner) in the combined material must be monitored to assure sufficient latent image charge pattern development without image disrupting defects or underdevelopment of the latent image charge pattern. Toner monitors and the associated control devices to regulate pigmented marking particle concentration require extremely sensitive complex instruments and apparatus. Such instruments and control apparatus are subject to numerous failure modes during which defective image development may occur, or in the extreme, may require that the development apparatus be shut down completely.

SUMMARY OF THE INVENTION

This invention is directed to a magnetic brush development apparatus of reduced size, which maintains substantially optimum toner concentration without the use of a toner monitor. In accordance with this invention, the magnetic brush development apparatus comprises a housing defining, in a portion thereof, a sump for containing a mixture of magnetic carrier particles and pigmented marking particles. A mixer is located in the sump of the housing for mixing magnetic carrier particles and pigmented marking particles so as to effect a triboelectric attraction of the pigmented marking particles to the magnetic carrier particles. The mixed magnetic carrier particles and attracted pigmented marking particles are attracted to an intermediate member, transported by the intermediate member from the sump, and then separated by the intermediate member such that the magnetic carrier particles are returned to the sump. A magnetic brush development roller including a magnetic core and a shell rotatable relative to one another, has the shell coated with a prescribed layer of magnetic carrier particles and an electrical bias applied to the shell. The marking particles are attracted from the intermediate member to the magnetic brush and then transferred to a latent image charge pattern on the dielectric member to develop such pattern.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
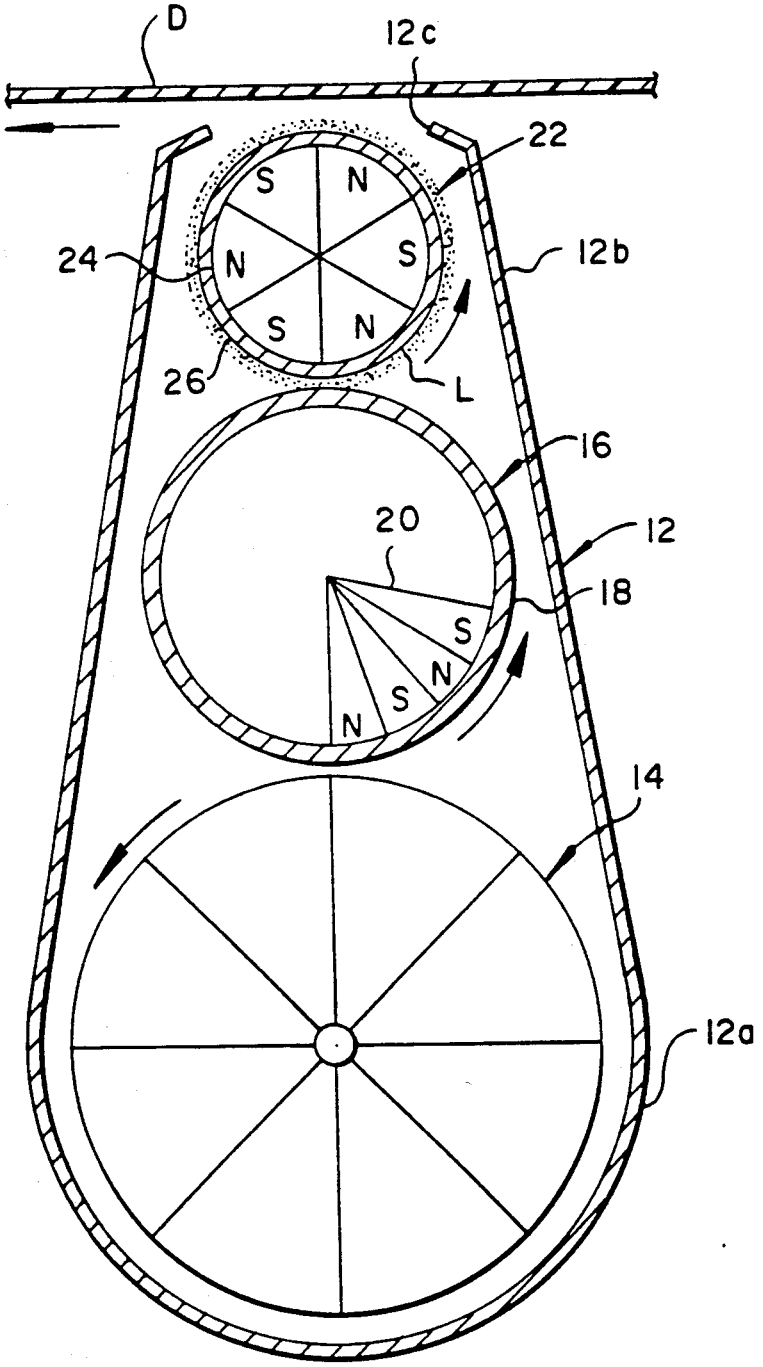
FIG. 1 is side elevational view, in cross-section of a magnetic brush development apparatus according to this invention.
Figure 2:
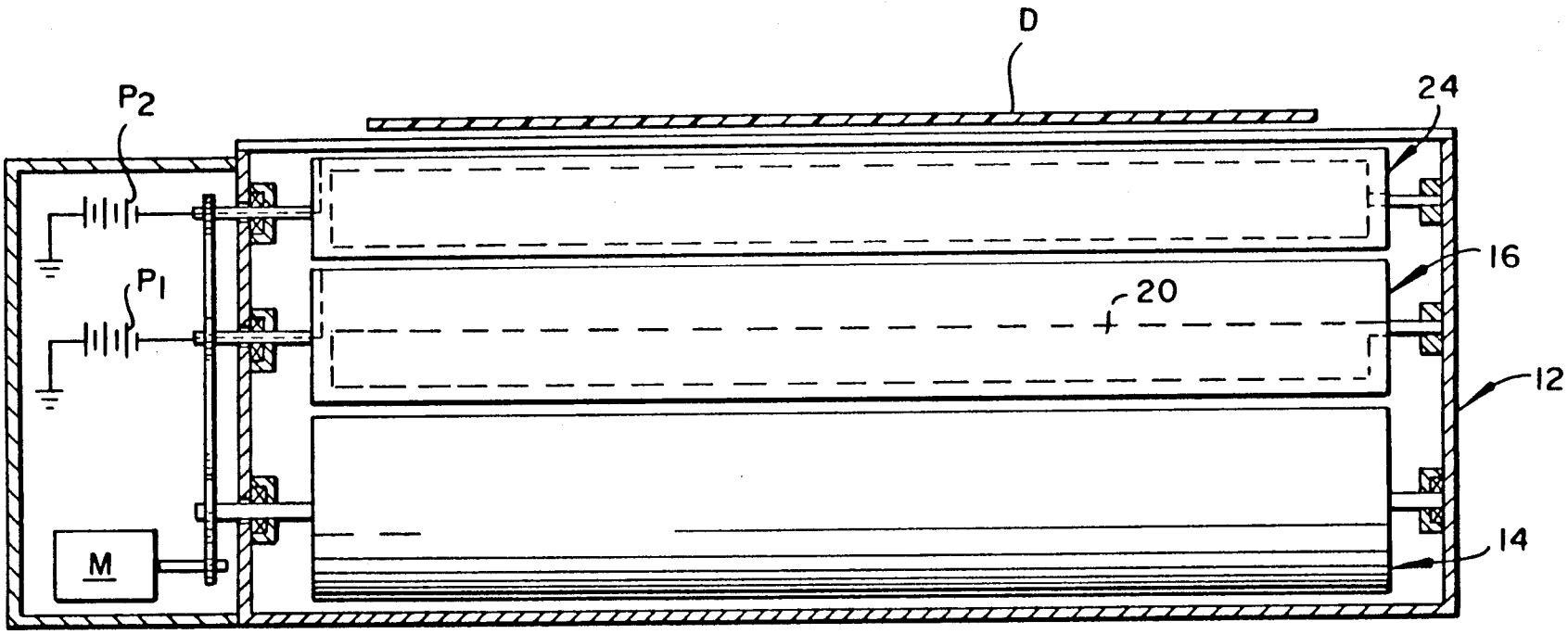
FIG. 2 is a front elevational view, partly in cross-section, of the magnetic brush development apparatus according to this invention.

Referring now to the accompanying drawings, FIGS. 1 and 2 show a magnetic brush development apparatus, designated generally by the numeral 10, according to this invention. The magnetic brush development apparatus 10 is suitable for use in any typical electrostatographic reproduction apparatus (not shown) employing a dielectric member upon which a latent image charge pattern is formed. Such apparatus 10 includes a housing 12 having a lower portion 12*a* defining a sump for containing pigmented marking particles and magnetic carrier particles. A mixing device 14 is located in the sump of the housing lower portion 12*a*. The mixing device 14 is for example a paddle wheel or ribbon type blender, which on rotation (by a motor M for example), thoroughly mixes the pigmented marking particles and magnetic carrier particles in the sump. Such mixing action generates a triboelectric attraction causing the pigmented marking particles to adhere to the magnetic carrier particles. Further, the mixing device 14 serves to transport the particle mixture toward an intermediate device 16.

The intermediate device 16 includes a rotatable electrically conducting shell 18 (also rotated for example by motor M) and a nonrotatable magnetic core 20 located within the shell. The shell 18 is connected to an electrical power source $P_1$ selected to bias the shell to a prescribed voltage of the opposite polarity to that of the triboelectrically charged pigmented marking particles.

Thus the mixed magnetic carrier particles and attracted pigmented marking particles are attracted to the device 16 by the electrical field created by the bias applied to the shell 18 and by the magnetic field generated by the magnetic core 20.

As clearly shown in FIG. 1, the magnetic core 20 of the intermediate device 16 is of a configuration whereby its magnetic field is directed so as to be effective only over a minor portion of the intermediate device substantially toward the mixing device 14. As a result, as the shell 18 is rotated, the mixed magnetic carrier particles and attracted pigmented marking particles are attracted to the shell and rotate therewith until the particle mixture leaves the influence of the magnetic field of the core 20. At this point the electrical bias on the shell 18 attracts the pigmented marking particles from the magnetic carrier particles to the peripheral surface of the shell so that the pigmented marking particles continue to be transported with the rotating shell. At the same time, the magnetic carrier particles, which are now out of the influence of the magnetic field of the core 20, fall back into the sump and the mixing device 14.

The pigmented marking particles attracted to the surface of the rotating shell 18 of the intermediate device 16 are transported to the vicinity of a magnetic brush developer roller 22. The developer roller 22 is located in the upper portion 12*b* of the housing 12 adjacent to an opening 12*c*. The opening 12*c* is located in juxtaposition with a dielectric member D of the electrostatographic reproduction apparatus and establishes a development zone between the development roller 22 and the dielectric member. As discussed above, the dielectric member D carries a latent image charge pattern to be developed by the apparatus 10. The image carrying dielectric member is movable past the development apparatus 10 in order to bring the carried latent image charge pattern into operative association with the development roller 22 to accomplish development in the development zone.

The magnetic brush development roller 22 includes an alternating pole magnet 24 and an electrically conducting shell 26. The magnet 24 and shell 26 are relatively rotatable. Such relative rotation may be accomplished by holding the magnet stationary and rotating the shell, holding the shell stationary and rotating the magnet, or by rotating the shell and magnet at different angular velocities. Again, rotation may be accomplished by the motor M in any suitable manner.

The surface of the shell 26 of the development roller 22 is coated with a prescribed layer L of magnetic carrier particles. The magnetic carrier particles of such layer are ferrite particles, for example similar to those in the sump or smaller and harder, with the layer having a thickness of approximately between 0.012–0.025 cm. Further, the shell 26 is connected to an electrical power source $P_2$ selected to apply a bias to the shell of a prescribed voltage. The electrical field on the shell 26 of the development roller 22 created by the bias applied thereto attracts pigmented marking particles from the surface of the shell 18 of the intermediate device 16 to the shell 26, and to the magnetic carrier particle layer L on the surface of such shell. Accordingly, the multibristle-like arrangement of magnetic marking particles and attracted pigmented marking particles is formed on the shell 26. The relative rotation of the shell 26 and magnet 24 then causes the pigmented marking particle loaded bristles to be swept over the dielectric member D in the development zone where the latent image charge pattern will attract the pigmented marking particles from the bristles to develop the image.

In order to assure that development of the latent image charge pattern on the dielectric member D is sufficiently and effectively carried out by the magnetic brush development apparatus 10 of this invention, the relative electrical biases applied to the shell 18 of the intermediate member 16 and the shell 26 of the development roller 22 must be of a prescribed relationship. That is, it has been determined that, with typical pigmented marking particles, to enable sufficient particles to be available for image development, an electrical field differential in the range of approximately 80 to 120 volts is necessary between the dielectric member D and the shell 26 and between the shell 26 and the shell 18. Such electrical field differential will assure attraction of sufficient pigmented marking particles to the layer L on the shell 26 of the development roller 22 (and thence to the latent image charge pattern on the dielectric member D) without forcing carrier particles of an opposite polarity from the shell 26 to the shell 18. As an illustrative example, if triboelectrically charged pigmented marking particles are of a predominantly positive polarity and the dielectric member D exhibits a charge in the range of approximately −300 volts, the bias applied to shell 26 of the development roller 22 should be approximately −200 volts and the bias applied to the shell 18 of the intermediate member 16 should be approximately −100 volts.

It is important to note that the layer L of magnetic carrier particles on the surface of the shell 26 of the development roller 22 is self-limiting. That is, pigmented marking particles will only be attracted from the intermediate device 16 to the development roller 22 as they are needed (e.g., as pigmented marking particles are depleted from the magnetic particle carrier layer due to latent image charge pattern development). Accordingly, the pigmented marking particle concentration is kept at an optimum level without the need to provide a toner monitor to enable control to provide such optimum concentration level. Moreover, since only a layer of magnetic carrier particles, of prescribed thickness, is required in the development zone, the overall volume of carrier particles in the apparatus 10 is reduced. This enables the size of the development apparatus to be concomitantly reduced.

The invention has been described in detail with particular reference to preferred embodiments thereof, but it will be understood that variations and modifications can be effected within the spirit and scope of the invention.

We claim:

1. A magnetic brush development apparatus for applying pigmented marking particles to a latent image charge pattern on a dielectric member, said magnetic brush development apparatus comprising:

a housing defining, in a portion thereof, a sump for containing a mixture of magnetic carrier particles and pigmented marking particles;

means located in said sump of said housing for mixing magnetic carrier particles and pigmented marking particles so as to effect a triboelectric attraction of said pigmented marking particles to said magnetic carrier particles;

intermediate means for attracting mixed magnetic carrier particles and attracted pigmented marking particles, transporting said mixed magnetic carrier particles and attracted pigmented marking particles from said sump, and then separating said pigmented marking particles from said magnetic carrier particles, returning said magnetic carrier particles to said sump; and a magnetic brush development roller including a magnetic core and a shell rotatable relative to one another, said shell being coated with a prescribed layer of magnetic carrier particles whereby, as required, marking particles are attracted from said intermediate means to said magnetic brush and then transferred to a latent image charge pattern on said dielectric member to develop such pattern.

2. The magnetic brush development apparatus of claim 1 wherein said shell of said development roller has an electrical bias applied thereto.

3. The magnetic brush development apparatus of claim 2 wherein said intermediate means includes means for applying an electrical bias in order to attract pigmented marking particles left on said intermediate means after separation of pigmented marking particles from magnetic carrier particles.

4. The magnetic brush development apparatus of claim 3 wherein the electrical bias applied to pigmented marking particles left on said intermediate means is on the order of 80–120 volts different from the triboelectric charge attracting pigmented marking particles to magnetic carrier particles.

5. The magnetic brush development apparatus of claim 2 wherein said intermediate means further includes a rotatable shell and a nonrotating magnetic core within said shell, said magnetic core configured to exhibit a magnetic field directed over a minor portion of said intermediate means substantially toward said mixing means.

6. The magnetic brush development apparatus of claim 5 wherein the electrical bias is applied to said shell of said intermediate means, and such electrical bias is on the order of 80–120 volts different from the triboelectric charge attracting pigmented marking particles to magnetic carrier particles.

7. The magnetic brush development apparatus of claim 5 wherein the electrical bias applied to said shell of said magnetic brush development roller is on the order of 80–120 volts different from the electrical bias applied to said shell of said intermediate means.

8. The magnetic brush development apparatus of claim 5 wherein the electrical bias applied to said shell of said magnetic brush development roller is on the order of 80–120 volts different from the charge on said dielectric member.

9. The magnetic brush development apparatus of claim 5 wherein the electrical bias applied to pigmented marking particles left on said intermediate means is on the order 80–120 volts different from the triboelectric charge attracting pigmented marking particles to magnetic carrier particles, the electrical bias applied to said shell of said magnetic brush development roller is on the order of 80–120 volts different from the electrical bias applied to said shell of said intermediate means, and the electrical bias applied to said shell of said magnetic brush development roller is on the order of 80–120 volts different from the charge on said dielectric member.

10. The magnetic brush development apparatus of claim 1 wherein the prescribed layer of magnetic carrier particle on said shell of said development roller is of a thickness of approximately between 0.012–0.025 cm.

11. A method for developing a latent image charge pattern on a dielectric member by applying pigmented marking particles to a latent image charge pattern, said method comprising the steps of:

mixing magnetic carrier particles and pigmented marking particles in a sump so as to effect a triboelectric attraction of said pigmented marking particles to said magnetic carrier particles;

attracting mixed magnetic carrier particles and attracted pigmented marking particles and transporting said mixed magnetic carrier particles and attracted pigmented marking particles from said sump;

separating said pigmented marking particles from said magnetic carrier particles, returning said magnetic carrier particles to said sump; and applying an electrical bias to a magnetic brush development roller coated with a prescribed layer of magnetic carrier particles to attract the separated pigmented marking particles to such roller and transfer such particles to a latent image charge pattern on a dielectric member to develop such pattern.

* * * * *